US006954037B2

(12) United States Patent
Hu

(10) Patent No.: US 6,954,037 B2
(45) Date of Patent: Oct. 11, 2005

(54) ELECTRODELESS LIGHTING SYSTEM

(75) Inventor: Hyun-Soo Hu, Gyeongsangbuk-Do (KR)

(73) Assignee: LG Electronics Inc. (KR)

( * ) Notice: Subject to any disclaimer, the term of this patent is extended or adjusted under 35 U.S.C. 154(b) by 65 days.

(21) Appl. No.: 10/768,625

(22) Filed: Jan. 29, 2004

(65) Prior Publication Data

US 2005/0062426 A1 Mar. 24, 2005

(30) Foreign Application Priority Data

Sep. 3, 2003 (KR) ..... 10-2003-0061446

(51) Int. Cl.[7] ..... H05B 41/16

(52) U.S. Cl. ..... 315/248; 315/246; 315/344; 315/312

(58) Field of Search ..... 315/248, 246, 315/344, 312, 324

(56) References Cited

U.S. PATENT DOCUMENTS 6,661,183 B2 * 12/2003 Park et al. ..... 315/248
6,734,638 B2 * 5/2004 Kang et al. ..... 315/248

* cited by examiner

*Primary Examiner*—Tuyet Thi Vo
(74) *Attorney, Agent, or Firm*—Ostrolenk, Faber, Gerb & Soffen, LLP

(57) ABSTRACT

In the electrodeless lighting system according to the present invention, a position of a stud mounted inside the resonator can be changed, the size of the stud mounted inside the resonator can be changed, or the number of studs can be changed thereby changing distribution of intensity of the electromagnetic field distributed inside the resonator, so that one of the luminescent materials within the first and second bulbs selectively emits light according to the taste of a user or a season. Accordingly, in the present invention, desired light of various kinds can be emitted.

12 Claims, 4 Drawing Sheets

ELECTRODELESS LIGHTING SYSTEM

BACKGROUND OF THE INVENTION

1. Field of the Invention

The present invention relates to an electrodeless lighting system, and more particularly, to an electrodeless lighting system capable of selectively illuminating an electrodeless bulb among a plurality of electrodeless bulbs installed inside the resonator.

2. Description of the Background Art

In general, a lighting instrument using a microwave is an apparatus in which a microwave is added to an electrodeless plasma bulb thereby emitting visible rays and ultraviolet rays. The lighting instrument has a bulb with longer lifetimes than a general incandescent lamp, or a fluorescent lamp, and has excellent efficiency in lighting.

FIG. 1 is a sectional view illustrating a conventional electrodeless lighting system, and FIG. 2 is an enlarged sectional view illustrating a bulb of an electrodeless bulb assembly of FIG. 1.

As shown in FIG. 1, a conventional electrodeless lighting system includes a casing 1; a high-tension generator 2 mounted inside the casing 1, and for generating a high tension; a microwave generator 3 mounted inside the casing 1 at a certain interval between itself and the high-tension generator 2, and for generating a microwave; a waveguide 4 for guiding a microwave generated at the microwave generator 3; a resonator 5 installed at the outside of the casing 1 so as to communicate with the waveguide 4, and generating a high intensity electromagnet field by exciting the microwave guided thereto through the waveguide 4; an electrodeless bulb assembly 6 rotatably mounted inside the resonator 5, and including a bulb in which a luminescent material forms a plasma thereby generating light; a mirror 7 positioned at a lower surface of the electrodeless bulb assembly 6, and for upwardly reflecting the light emitted from the electrodeless bulb assembly 6; and a reflector 8 for concentrating light generated at the electrodeless bulb assembly 6, and upwardly reflecting the light.

Inside the casing 1, a first driving motor 9 for rotating the electrodeless bulb assembly 6 is installed, and a rotation shaft 9*a* of the first driving motor 9 is connected with a shaft portion 6*a* of the electrodeless bulb assembly 6 by a connecting shaft 9*b*. And also, inside the casing 1, a cooling fan 11 and a second driving motor 12 for driving the cooling fan 11 are mounted in order to cool the heat generated at the high tension generator 2 and the microwave generator 3. At the casing 11, an air duct 13 for guiding external air to the high-tension generator 2 and the microwave generator 3 is provided.

As shown in FIG. 2, the electrodeless bulb assembly 6 consists of a transparent bulb 6*b* filled with a luminescent material, and a shaft portion 6*a* extended from the bulb 6*b* so as to be connected with the connecting shaft 9*b*.

Operations of the conventional electrodeless lighting system constructed as above will now be described.

When power is applied to an electrodeless lighting system, a high tension is generated at the high-tension generator 2, and a microwave is generated at a microwave generator by the high tension generated from the high-tension generator 2. The microwave is transmitted to a resonator 5 through a waveguide 4 and distributes a high intensity electromagnetic field at the resonator. At this time, the luminescent material within the electrodeless bulb 6*b* is discharged by the electromagnetic field, and simultaneously gasified, generating a plasma. The light which is emitted when the plasma is generated at the electrodeless bulb 6*b* is upwardly reflected by the mirror 7 and the reflector 8.

However, in the conventional lighting system, the electrodeless bulb assembly has only one bulb, so only one beam is emitted.

SUMMARY OF THE INVENTION

Therefore, an object of the present invention is to provide an electrodeless lighting system capable of selectively illuminating one of a plurality of electrodeless bulbs installed inside the resonator.

To achieve these and other advantages and in accordance with the purpose of the present invention, as embodied and broadly described herein, there is provided an electrodeless lighting system including a high-tension generator mounted at a casing, and for generating a high tension; a microwave generator mounted at the casing at a certain interval between itself and the high-tension generator so as to generate a microwave by the high-tension generated at the high-tension generator; a waveguide installed at the casing, and for guiding the microwave generated at the microwave generator; a resonator communicating with the waveguide so as to generate a high intensity electromagnetic field by exciting the microwave guided thereto through the waveguide; an electrodeless bulb assembly rotatably mounted inside the resonator, and including a plurality of bulbs, for generating light by forming a plasma; and a stud for controlling an impedance, which is installed inside the resonator, and selectively illuminating one of a plurality of bulbs of the electrodeless bulb assembly.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
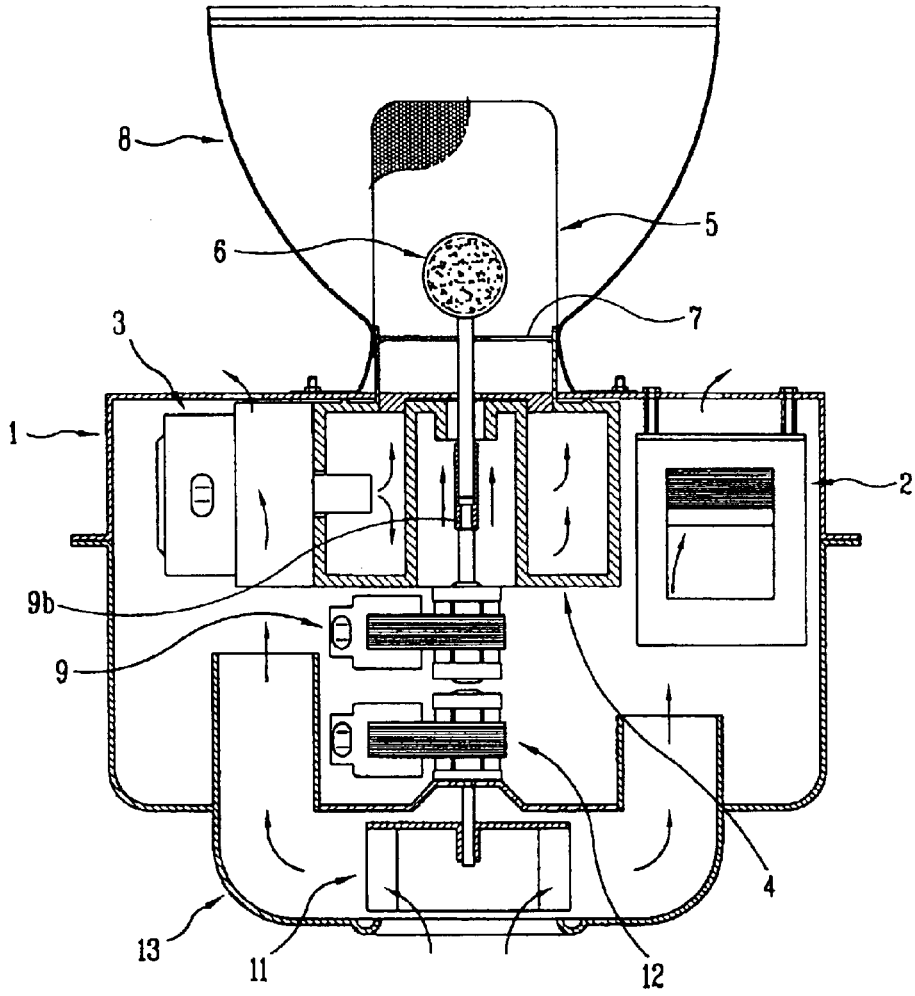
FIG. 1 CONVENTIONAL ART
FIG. 1 is a sectional view illustrating a conventional electrodeless lighting system.
Figure 2:
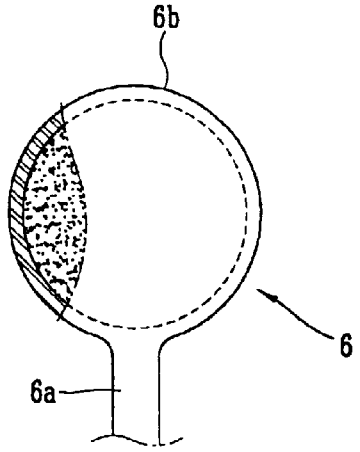
FIG. 2 CONVENTIONAL ART
FIG. 2 is an enlarged view illustrating an electrodeless bulb assembly of FIG. 1.
Figure 3:
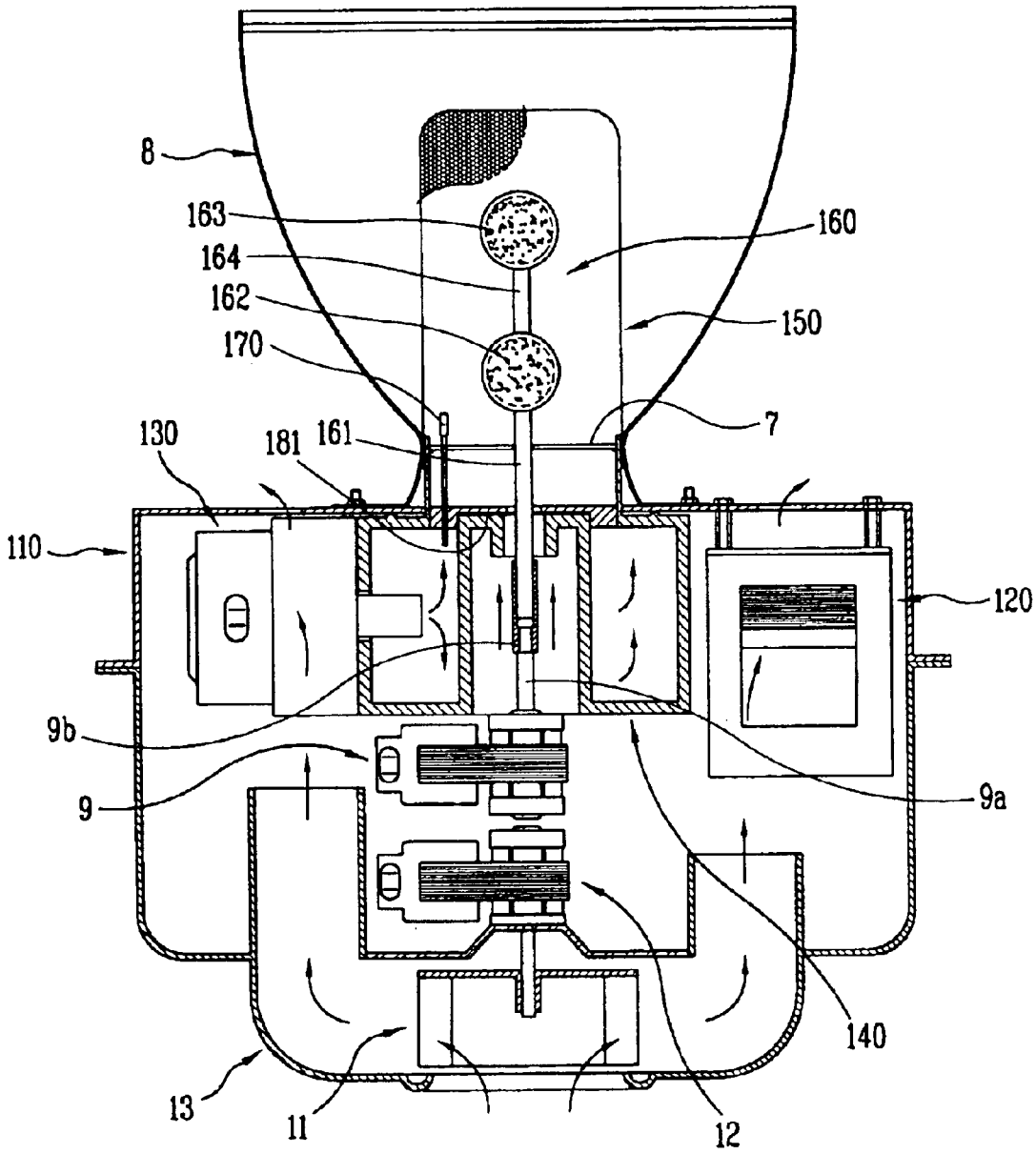
FIG. 3 is a sectional view illustrating an electrodeless lighting system according to the present invention.
Figure 4:
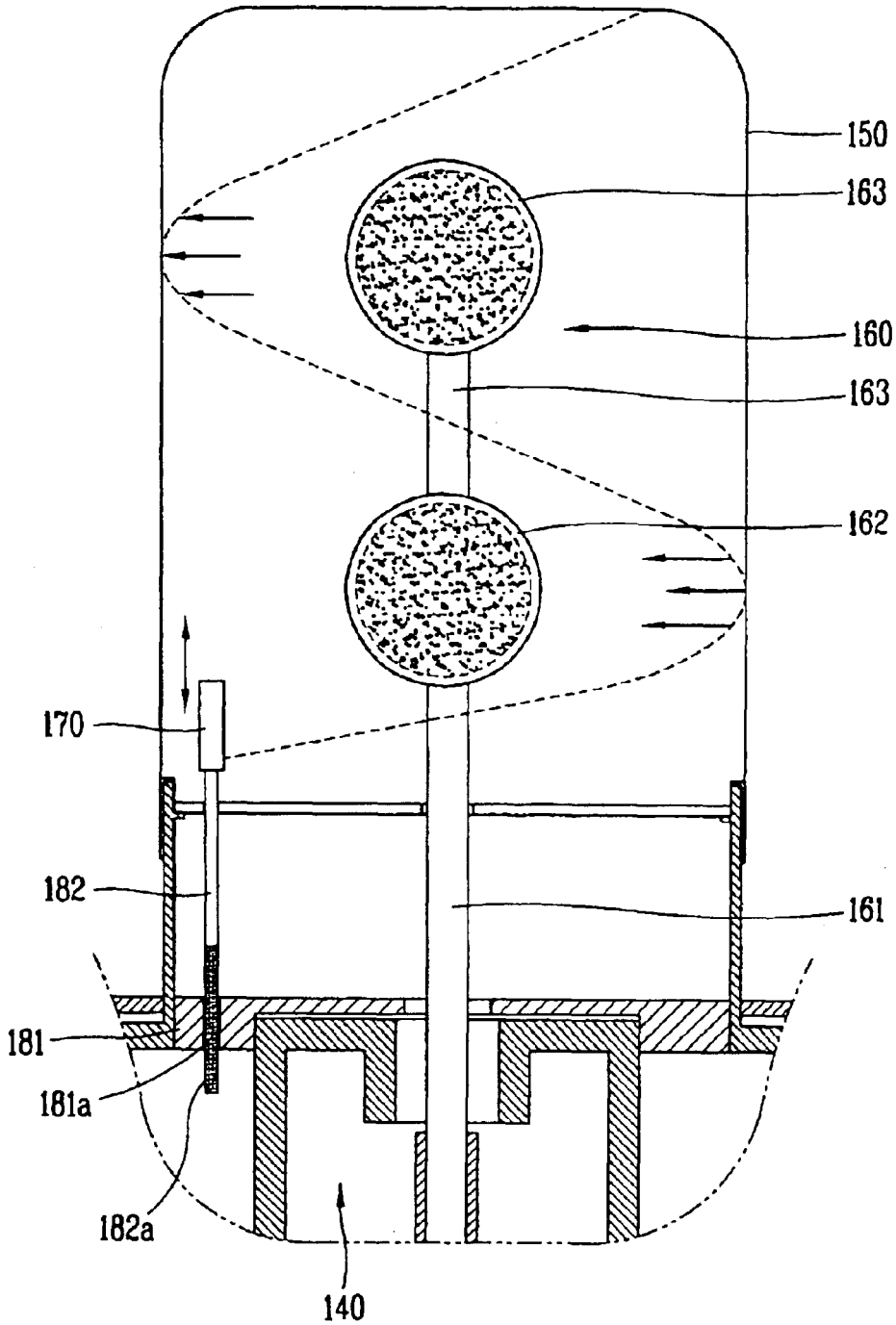
FIG. 4 is an enlarged view of a main part extracted from FIG. 3.

FIG. 2 is an enlarged view illustrating an electrodeless bulb assembly of FIG. 1, FIG. 3 is a sectional view illustrating an electrodeless lighting system according to the present invention, and FIG. 4 is an enlarged view of a main part extracted from FIG. 3.

As shown therein, an electrodeless lighting system according to the present invention includes a high-tension generator 120 mounted at a casing 110, and for generating a high tension; a microwave generator 130 mounted at the casing 110 at a certain interval between itself and the high-tension generator 120 so as to generate a microwave by the high tension generated at the high-tension generator 120; a waveguide 140 installed at the casing 110, and for guiding the microwave generated from the microwave generator 130; a resonator 150 communicating with the waveguide so as to generate a high intensity electromagnetic field by exciting the microwave guided thereto through the waveguide 140; an electrodeless bulb assembly 160 rotatably mounted inside the resonator 150, and including a plurality of bulbs, and emitting light by forming a plasma; and a stud 170 for controlling an impedance (hereinafter, referred to as 'stud'), installed inside the resonator 150, and selectively illuminating one of a plurality of bulbs of the electrodeless bulb assembly 160.

A mirror 7 is positioned at the lower portion of the electrodeless bulb assembly 160 to upwardly reflect the light emitted at the electrodeless bulb assembly 160. A reflector 8 for encompassing the resonator 150 and for collecting light generated at the electrodeless bulb assembly 160 and upwardly reflecting the light is installed at an upper portion of the waveguide 140.

Inside the casing 110, a first driving motor 9 for rotating the electrodeless bulb assembly 160 is installed, and a rotation shaft 9*a* of the first driving motor 9 is connected with a first shaft portion 161 of the electrodeless bulb assembly 160 by a connecting shaft 9*b*. In order to cool the heat generated at the high-tension generator 120 and the microwave generator 130, a cooling fan 11 and a second driving motor 12 for driving the cooling fan are mounted inside the casing 110.

At the casing 110, an air duct 13 for guiding air to the high-tension generator 120 and the microwave generator 130 is provided.

The electrodeless bulb assembly 160 includes a first shaft portion 161 connected with the rotation shaft 9*a* of the driving motor 9 through the connecting shaft 9*b*; a first transparent bulb 162 formed at an upper portion of the first shaft portion 161, and filled with a first luminescent material; a second transparent bulb 163 positioned at an upper part of the first bulb 162, and filled with a second luminescent material; and a second shaft portion 164 connecting the first bulb 162 and the second bulb 163.

A luminescent material within the bulb 162, 163 of the electrodeless bulb assembly 160 contains a material such as metal, that is, a halide compound, sulfur or selenium, which emits light with forming a plasma; inactive gas such as argon, xenon and krypton for forming a plasma at an initial stage of light-emitting; and an addition for making lighting easy by activating an initial electric discharge or for controlling spectrum of the generated light and the like.

In addition, the stud 170 is vertically moved by the stud moving means, and is detachably/attachably installed inside the resonator 150, The stud moving means includes a frame 181 installed at an upper portion of the waveguide 140, and having an upper surface where a screw hole 181*a* is formed; and a moving member 182 having an upper portion to which the stud 170 is fixed, and a lower portion where a screw 182*a* coupled to the screw hole 181*a* is formed.

Hereinafter, operations of the electrodeless lighting system constructed as above will now be described.

When power is applied to the electrodeless lighting system, a microwave is generated at the microwave generator 130 by a high-tension generated at the high-tension generator 120. The microwave is transmitted to the resonator 150 through the waveguide 140, and distributes a high intensity electromagnetic field. At this time, the luminescent material within the electrodeless bulb assembly 160, is discharged by the electromagnetic field, and simultaneously gasified, generating a plasma.

At this time, since the screw 182*a* is coupled to the screw hole 181*a*, the position of the stud 170 fixed at an upper end of the moving member 182 is controlled by turning the moving member 182.

If the height of the stud 170 is vertically controlled and thus changed, the distribution of intensity of the electromagnetic field which is distributed in the resonator 50 is changed. At this time, as the distribution of the intensity of the electromagnetic field is changed, one of a luminescent material within the first bulb 162 and a luminescent material within the second bulb 163 is selectively discharged, and simultaneously gasified, generating a plasma.

For example, the first bulb 162 is filled with a luminescent material emitting a high color temperature, and the second bulb 163 is filled with a luminescent material emitting a low color temperature.

In summer, preferably, the position of the stud 170 is changed so that intensity of the electromagnetic field has high distribution in the resonator 50, thereby emitting white light or blue light, to feel cool. In winter, preferably, the position of the stud 170 is changed so that the intensity of the electromagnetic field has low distribution in the resonator 50, thereby emitting red light, to feel warm.

The light emitted while a plasma is generated at the electrodeless bulb assembly 160 is upwardly reflected by the mirror 7 and the reflector 8.

At the same time, as the first driving motor 9 is operated to rotate the electrodeless bulb assembly 160, the electrodeless bulb assembly 160 is cooled. And also, as the second driving motor 12 is operated to rotate the cooling fan 11, external air is flowed through the air duct 13 so that the high-tension generator 120 and the microwave generator 130 are cooled.

Figure 5:
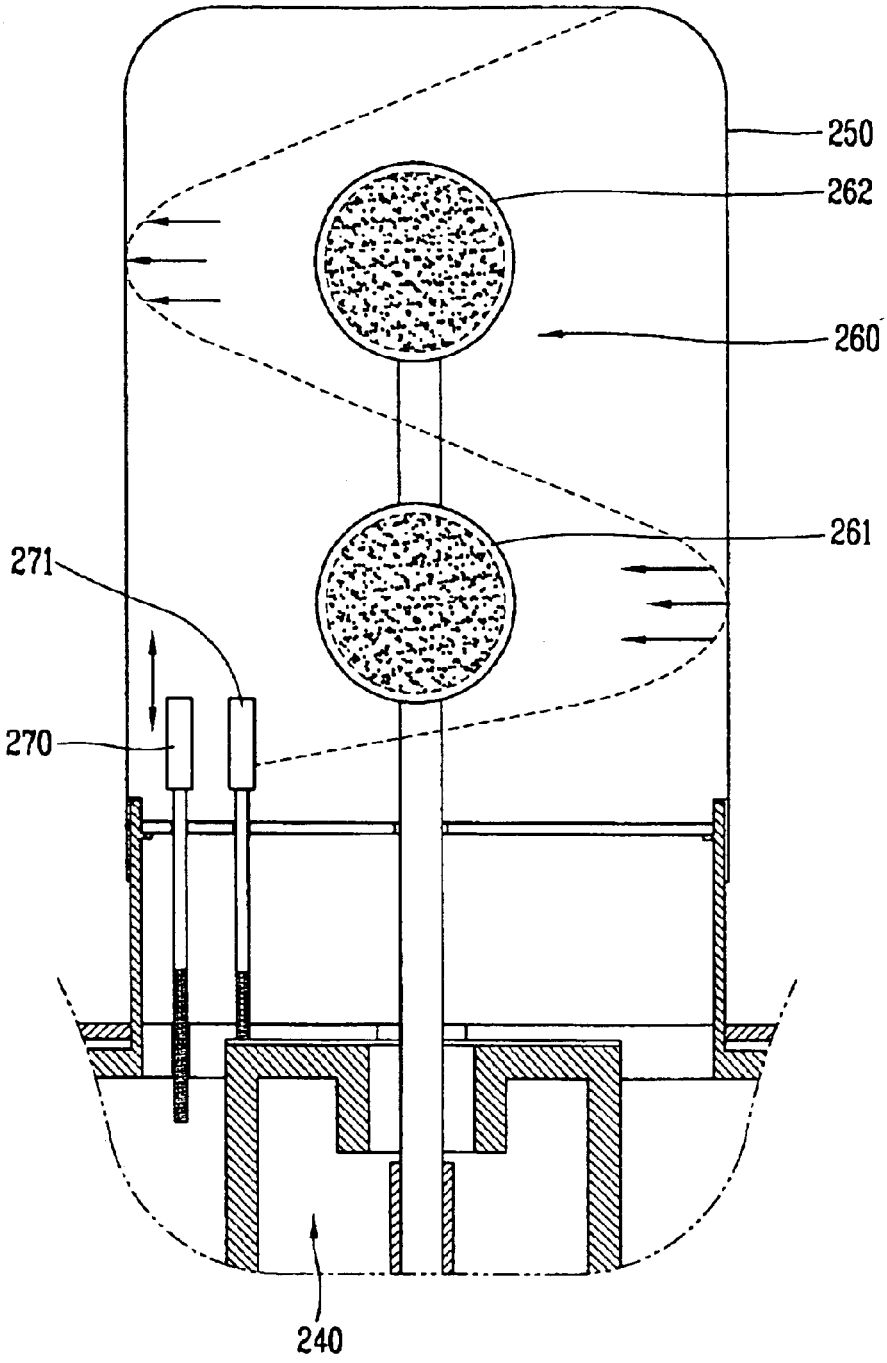
FIG. 5 is a sectional view illustrating a different embodiment of an electrodeless lighting system according to the present invention.

FIG. 5 is a sectional view illustrating a different embodiment of an electrodeless lighting system according to the present invention.

As shown therein, in the different embodiment of the electrodeless lighting system according to the present invention, an electrodeless bulb assembly 260 (261, 262) is rotatably mounted inside the resonator 250 so as to generate light by forming a plasma, and a plurality of studs 270, 271 whose sizes and heights are different from each other is installed inside the resonator 250.

When power is applied to such an electrodeless lighting system, a microwave is generated at a microwave generator 130 by a high tension generated at the high-tension generator. The microwave is transmitted to the resonator 250 through the waveguide 240, to distribute a high intensity electromagnetic field. At this time, the distribution of the intensity of the electromagnetic field distributed in the resonator 250 is changed according to each stud 270, 271. According to the change of the distribution of the intensity of the electromagnetic field, a luminescent material within one of a plurality of bulbs 261, 262 is selectively discharged, and simultaneously gasified, generating a plasma. The light emitted while the plasma is generated at the electrodeless bulb assembly 160 is upwardly reflected by a mirror (not shown) and a reflector, As so far described, in the electrodeless lighting system according to the present invention, a position of a stud mounted inside the resonator can be changed, the size of the stud mounted inside the resonator can be changed, or the number of studs can be changed thereby changing distribution of intensity of the electromagnetic field distributed in the resonator, so as to selectively illuminate one of the luminescent materials within the first and second bulbs according to the taste of a user or a season. Accordingly, in the present invention, desired light of various kinds can be emitted.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An electrodeless lighting system comprising:

a high-tension generator mounted at a casing, and for generating a high tension;

a microwave generator mounted at the casing at a certain interval between itself and the high-tension generator so as to generate a microwave by the high-tension generated at the high-tension generator;

a waveguide installed at the casing, and for guiding the microwave generated at the microwave generator;

a resonator communicating with the waveguide so as to generate a high intensity electromagnetic field by exciting the microwave guided thereto through the waveguide;

an electrodeless bulb assembly rotatably mounted inside the resonator so as to emit light with forming a plasma, and including a plurality of bulbs; and a stud installed inside the resonator, and for selectively illuminating one of the plurality of bulbs of the electrodeless bulb assembly.

2. The electrodeless lighting system of claim 1, wherein the electrodeless bulb assembly comprises:

a first shaft portion connected to a rotation shaft of a driving motor;

a first transparent bulb formed at an upper portion of the first shaft portion, and filled with a first luminescent material;

a second transparent bulb formed an upper part of the first bulb, and filled with a second luminescent material; and a second shaft portion connecting the first bulb and the second bulb.

3. The electrodeless lighting system of claim 1, wherein the stud is made of a conductive material.

4. The electrodeless lighting system of claim 1, wherein the stud is detachably/attachably installed inside the resonator.

5. The electrodeless lighting system of claim 1, further comprising a moving means for moving a position of the stud.

6. The electrodeless lighting system of claim 5, wherein the stud moving means comprises:

a frame installed at an upper portion of the waveguide, and having a screw hole at its upper surface; and a moving member having an upper portion to which the stud is fixed and a lower portion where a screw coupled to the screw hole is formed.

7. An electrodeless lighting system comprising:

a high-tension generator mounted at a casing, for generating a high-tension;

a microwave generator mounted at the casing at a certain interval between itself and the high-tension generator so as to generate a microwave by the high tension generated at the high-tension generator;

a waveguide installed at the casing, for guiding the microwave generated at the microwave generator;

a resonator communicating with the waveguide so as to generate a high intensity electromagnetic field by exciting the microwave guided thereto through the waveguide;

an electrodeless bulb assembly rotatably mounted inside the resonator, and generating light with forming a plasma, and including a plurality of bulbs; and a plurality of studs installed inside the resonator, and for selectively illuminating one of a plurality of bulbs of the electrodeless bulb assembly.

8. The electrodeless lighting system of claim 7, wherein the electrodeless bulb assembly comprises:

a first shaft portion connected to a rotation shaft of a driving motor;

a first transparent bulb formed at an upper portion of the first shaft portion, and filled with a first luminescent material;

a second transparent bulb positioned at an upper part of the first bulb, and filled with a second luminescent material; and a second shaft portion connecting the first bulb and the second bulb.

9. The electrodeless lighting system of claim 7, wherein the stud is made of a conductive material.

10. The electrodeless lighting system of claim 7, wherein the stud is detachably/attachably installed inside the resonator.

11. The electrodeless lighting system of claim 7, further comprising a moving means for moving the position of the stud.

12. The electrodeless lighting system of claim 11, wherein the stud moving means comprises:

a frame installed at an upper portion of the waveguide, and having an upper surface where a screw hole is formed; and a moving means having an upper portion to which the stud is fixed and a lower portion where the screw coupled to the screw hole is formed.

* * * * *